United States Patent [19]

Scott et al.

[11] 4,017,051

[45] Apr. 12, 1977

[54] LIGHTWEIGHT CONCRETE BEAM FORM

[76] Inventors: Samuel C. Scott, Rte. 1, Box 369, Franktown, Colo. 80116; David R. Wells, 6862 Marshall St., Arvada, Colo. 80003

[22] Filed: Aug. 18, 1975

[21] Appl. No.: 605,321

[52] U.S. Cl. ..... 249/50; 249/115; 249/134

[51] Int. Cl.[2] ..... E04G 13/04

[58] Field of Search ..... 249/50, 112, 134, 28–30, 249/188–189, 193, 115

[56] References Cited

UNITED STATES PATENTS

| | | | |
|---|---|---|---|
| 982,055 | 1/1911 | Hallberg | 249/29 |
| 1,090,583 | 3/1914 | Venable | 249/50 |
| 1,628,385 | 5/1927 | Bauer | 249/50 |
| 3,063,122 | 11/1962 | Katz | 249/50 |
| 3,248,758 | 5/1966 | Schmitz et al. | 249/134 |
| 3,350,049 | 10/1967 | Reiland | 249/134 |
| 3,381,929 | 5/1968 | Banker | 249/189 |
| 3,434,689 | 3/1969 | Aftreth | 249/134 |
| 3,792,830 | 2/1974 | Dashew et al. | 249/28 |

OTHER PUBLICATIONS

General Catalog, Form-Crete Steel Forms, 1959, pp. 1, 3.

*Primary Examiner*—Francis S. Husar
*Assistant Examiner*—John McQuade

[57] ABSTRACT

A lightweight, very strong form of a concrete beam includes a plurality of U-shaped brace members having vertical, lightweight steel deck sheets secured to the uprights thereof, a strippable, non-stick, plastic liner for contacting the concrete of the beam and a rigid foamed plastic filling the space between the liner and the steel sheets, so that it supports the weight of the concrete poured onto the strippable, plastic liner. A column form is arranged to mate with the beam form, and the beam form may be used to mate with flying deck forms producing an integral, combined column, beam and deck structure. The forms are arranged for easily joining short beam sections to make long beam forms, and to join columns and floor decks with a smooth joint requiring no finishing. The strength of the beam forms reduces the quantity of supports necessary to hold the weight of the forms and poured concrete, and their configuration provides easy and quick stripping of the forms from the set concrete.

7 Claims, 17 Drawing Figures

LIGHTWEIGHT CONCRETE BEAM FORM

Concrete constructions in some current designs utilize integral beams and decks. In some cases, it has been found desirable to utilize integral columns with the beams and decks. A major problem is encountered in the placement of forms for in-place cast beams, particularly when the beams are formed integrally with the columns supporting the beams with the decks extending laterally from beams. This problem is the removal of the forms after the concrete has set sufficiently to permit the removal of the forms. In all cases, the beam form must be spaced from the column form and from the deck form so that these forms may be stripped downwardly from the finished concrete. Heretofore, this has always left a substantial joint deformity in the set concrete which must be corrected and patched by additional concrete, which requires skilled labor for the patching, and, of course, it does not produce an aesthetic structure at that point. Another problem which occurs is the actual stripping of the concrete beam form from the set concrete. The usual method has been to use a form which permits spreading of the upright sides so that the beam form can be physically stripped from the beam and then the form dropped to remove it from the beam. Previous beam forms were heavy, requiring a substantial supporting structure merely to hold the heavy beam form in place. Such forms as wooden forms, fiberglass forms, and the like require the heavy backing to support the concrete poured in the mold. Further, since the forms do not easily release from the set concrete, they are most generally torn up on stripping the form from the beam. This, also, is very likely to scar the concrete which requires additional hand work to repair the damage. An additional disadvantage is the fact that they rack or twist. Because of their construction, they lack torsional strength which permits substantial racking One type of construction used in the prior art is shown in U.S. Pat. No. 2,583,670, issued Jan. 29, 1952 to T. Sato entitled Collapsible Concrete Beam Form. This patent exemplifies some attempts to overcome one of the main problems in the concrete construction, and that is the stripping of the forms from the set concrete. The patent describes a collapsible form in which the elements of the form are bolted together and then unbolted so as to release it from the set concrete. The invention further exemplifies the heavy structure necessary to support the beam in its desired shape. Another type of form construction is shown in U.S. Pat. No. 3,845,930, issued Nov. 5, 1974, in which combined beam and roof sections are supported on adjustable telescopic supports. The support is a mobile support and is clearly intended for use in tunnels. The particular type of construction is used for forming beams and a decking on pre-formed columns, fittings or foundations, and a floor slab. In addition to the Sato patent above using collapsible forms for removal of a form from a concrete beam, Wellander in U.S. Pat. No. 3,704,852, issued Dec. 5, 1972, describes a beam form which has movable side walls mounted with a lever arrangement which is necessary to break the sidewalls from the finished concrete. The construction is such to indicate that it is for precast concrete beams which are formed away from their point of use, and then lifted by cranes and transported to its point of use. In a similar manner, concrete I-beams are formed in a mold in U.S. Pat. No. 3,830,458, issued Aug. 20, 1974, which describes a form for concrete beams in which the sidewalls pivot upwardly and outwardly to release the I-beam of formed concrete. Another concrete beam form is shown in U.S. Pat. No. 3,645,490, issued Feb. 29, 1972, for making essentially rectangular beams in which the sidewalls are pivoted so as to pivot away from the formed beam. The frame for the form clearly shows that it is arranged for producing different sizes of beams, that the walls for the beam form are broken from the set concrete by pivoting outwardly and downwardly from the set concrete.

According to the present invention there is provided a strippable beam form having means for providing a smooth finished joint between the cast beam and an integral structure such as a continuous deck, or an integral column, or the like. The form is arranged with a strippable, non-stick plastic material supported by rigid, plastic foam which is combined with steel decking to produce a high-strength, low-weight beam form. The foam, also, provides insulation for the concrete to provide an efficient optimum cure of the concrete. The beam form is very strong and rigid providing high resistance to twisting or racking movement and its rigidity and high strength permits it to be mounted on few lightweight supports. The strength of the form permits it to be cantilevered at its ends a substantial distance for an easy and smooth connection with other structures and which is readily strippable without destruction of the beam form or other structure forms. The structure of the beam form permits it to be easily attached to deck flying forms so as to produce a smooth joint that does not require hand finishing.

Included among the objects and advantages of the present invention is to provide a lightweight, strong and rigid form for in situ construction of concrete beams.

Another object of the invention is to provide effective gasketing means for connecting two or more beam forms together with an effective seal preventing leaking of concrete and forming a smooth joint between beam sections.

Another object of the invention is to provide a very lightweight, high strength beam form for concrete beams providing a strippable, plastic liner for the concrete beam mounted on a rigid foam supporting the concrete and insulating the same for curing.

Another object of the invention is to provide a highly versatile concrete beam form structure which may be used for attachment to flying deck forms and supporting column forms providing finished, smooth joints therebetween.

Yet another object of the invention is to provide a lightweight, high strength, concrete beam form which may be utilized for different types of beams by providing a lightweight, rigid foam insert so that the major beam structure may be utilized with different styles of beams.

An additional object of the invention is to provide a lightweight concrete beam form having a non-stick plastic sheet liner and a supporting framed plastic backing, including means for securing the two together.

These and other objects and advantages of the invention may be readily ascertained by referring to the following description and appended illustrations in which:

FIG. 5 is a perspective view of a plastic connector for joining a beam form with other beam forms, columns, and the like;

In general, the form for casting a concrete beam is made of a plurality of U-shaped supports spacedly attached along a pair of parallel, opposed corrugated metal sheets with a concrete supporting and concrete release sheet of a non-stick plastic sheet secured between the upright metal sheets held in the shape of the desired beam, and the space between the release sheet and the beam is filled with a rigid foam, for example, polyurethane foamed plastic. The polyurethane foam bonds to the corrugated steel members and to other support members forming a rigid structure of a concrete form, supporting the plastic sheet and the fluid concrete, producing a very light, very strong concrete beam form.

In the device selected for illustration in FIGS. 1–4, a plurality of U-shaped supports 10*a*, 10*b*, etc., are spacedly secured to a pair of corrugated steel sheets 12*a* and 12*b*. In one form, the U-shaped supports are made of hollow rectangular steel welded together so that uprights 11*a* and 11*b* are perpendicular to a lower lateral 11*c* and are welded at about the ends of the lateral 11*c*. The lower member 11*c* with open ends permits tools and braces to be placed therein for handling, supporting or the like. When made of steel, the steel plates 12*a* and 12*b* may, of course, be welded, riveted, bolted or otherwise rigidly secured to the metal uprights. One common form which has been found useful for the metal siding has been metal decking used with concrete decks providing reinforcing for the deck and, also, providing grooves for service lines in the floor. The beam forms may be made in 20 feet, 30 feet, 40 feet or other lengths as desired. One common length is 30 feet which may be used as a module, joinable with other forms end to end in gangs to produce longer beams where desired. The distance between the uprights may be 2, 3, 4, 5, 6 feet, with a usable span of about 4 feet. A bottom form support is formed of four lumber membrs 2 × 4 inches (or similar lumber) mounted vertically, e.g., the the members 14, 15, 16 and 17 mounted centrally on the laterals of the U-shaped supports and secured by bolting or otherwise holding them in their position. These are spaced apart for the reasons explained below. A plywood sheet may be used to cover the top of the uprights supporting a non-stick plastic sheet thereon. A top plate 20*a* is secured on top of the right side of the U-shaped members, and a top plate 20*d* is placed on the left side on top of the uprights. Normally these plates are 2 × 6 inches wooden plates and are secured to the post in any convenient manner. One form is an angle bracket 13 welded to the top of each upright.

Figure 1:
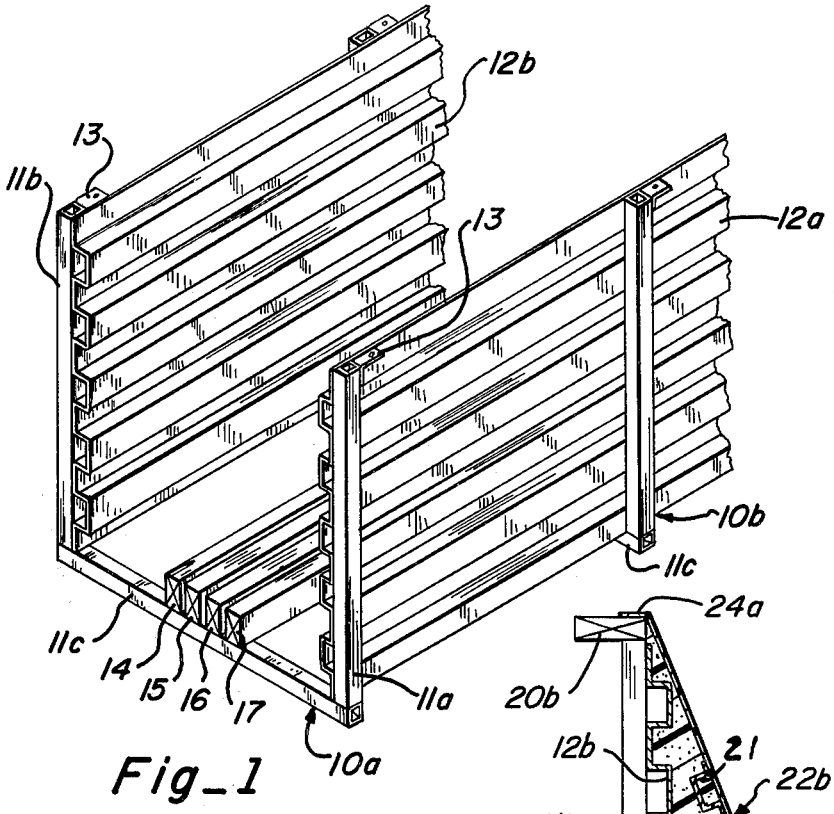
FIG. 1 is a perspective view of a portion of one construction of the invention illustrating a section of the frame for a concrete beam form according to the invention.
Figure 2:
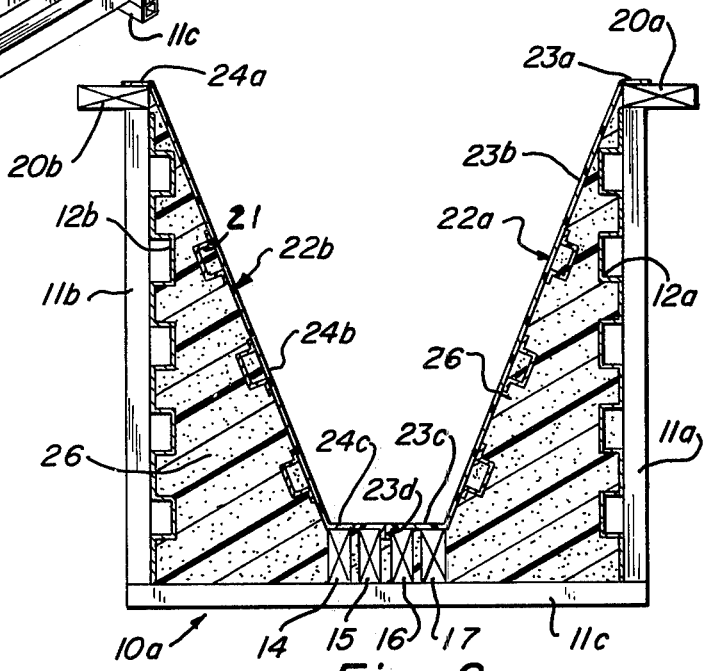
FIG. 2 is an end elevational view of a beam form ready for receiving concrete.
Figure 3:
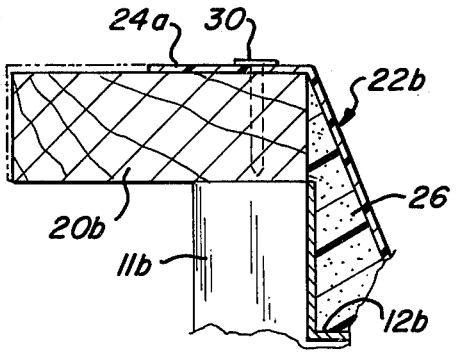
FIG. 3 is a partial, enlarged view of one type of connection for a strippable liner for a beam form according to the invention.
Figure 4:
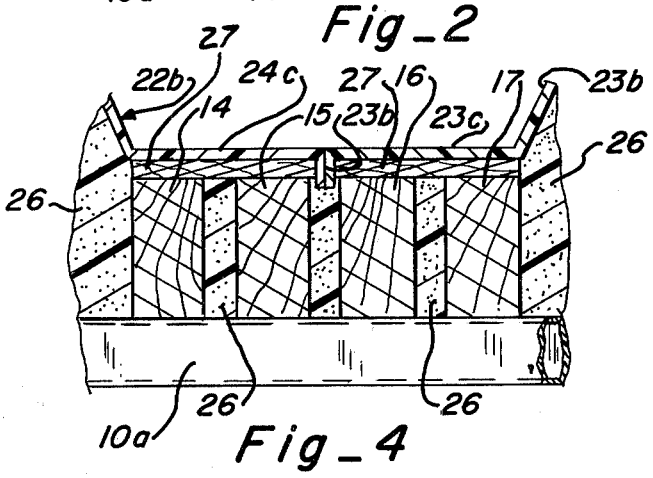
FIG. 4 is an enlarged detailed view of a form bottom support and connector mechanism for the beam form according to the invention.

A plastic sheet 22*a* is flexible, but essentially rigid and is secured to the plate 20*a*, FIG. 2, and terminates between supports 15 and 16, FIG. 4. The sheet 22*a* is formed into section 23*a* nailed or otherwise adhered to the plate 20*a*, an elongated sheet section 23*b* extending from the top plate to the bottom supports 16 and 17, and section 23*c* overlying the supports. An end section 23*d* extends over the support 16 and into the space between that support and supports 15. A mirror image side 22*b*, FIG. 3, is secured to the other side of the form with the end 24*a* secured by a nail 30 to beam 20*b*, and it, likewise, terminates between the space between 15 and 16. The profile produced by the two members 22*a* and 22*b* is the profile of the desired beam to be formed of concrete in that space in the beam. The section 23*c*, and its corresponding section 24*c* of the sheet 22*b*, is fastened to the bottom supports by means of nails, bolts or the like, and are securely held in position by the fastening. The plastic sheet is essentially rigid although somewhat flexible, and it is scored or bent (sometimes heated) to form the shaped members 22*a* and 22*b*. The plastic sheet is of a non-stick, slick plastic, such as essentially rigid polyethylene, polypropylene, polystyrene, and the like, to provide a good release for concrete poured in the form. The sheet may be 1/16, ⅛, ¼ inch or the like as determined by the size and use of the form. It is preferable that the inside surface of these two sheets be smooth to provide a non-stick surface and produce a smooth finish for the concrete; however, the other side may be scarred, knurled, include holders 21 embedded in the plastic, or otherwise attached to foamed plastic 26 between the plastic sheets and the metal uprights. An end seal, shown in FIG. 17, may now be placed over the ends of the beam form, and this includes an exterior plywood sheet 25 having a cutout 26 the same shape as the profile of the sheets 22*a* and 22*b*. The plywood sheet may be ¼ inch secured to the uprights to the bottom supports. The bottom may include support plywood sheets 27, where desired, FIG. 4.

With the elements of the beam form in place, the form is turned upside down and the space 26 between the steel sheets 12*a* and 12*b* is partially filled with a monomer which foams filling the space to produce a rigid foam. For example, some of the foams may be polyurethane, polyester, polycarbonate, or the like. A polyurethane is generally the currently preferred resin (synthetic plastic) since it is readily available commercially and it may be provided to produce a foam of 1 to 15 pounds per cubic foot. Preferably, sufficient foam is provided to fill the space, so that the foam contacts and covers the bottom lateral cross members of the U-shaped supports, and sufficient foam is provided to fill the spaces between the bottom lumber supports 14, 15, 16 and 17. Polyurethane adheres to the steel and wood surfaces, and as a rigid foam it supports the plastic sheets 22*a* and 22*b* embedding the loops 21 therein, combined for supporting fluid concrete poured into the beam shaped cavity. The rigid polyurethane foam bonds to the other structural members of steel and wood, and they mutually support each other in a rigid position. Specifically, the foam is sandwiched between the steel sheets making a strong, light structure. Further, the urethane foam between the bottom supports provides mutual rigidity and strength between the resin and the wooden members. When completed, a 3 × 3 feet form may generally run from 40 to 50 pounds per lineal foot.

Figure 17:
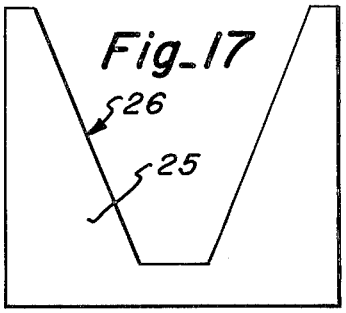
FIG. 17 is a front elevational view of a plywood end seal for covering the end of a beam form according to the invention.

After the polyurethane foam plastic has cured, the form may then be turned upright and moved into position for casting a concrete beam. Under normal circumstances, the form is adequately supported by a single support under each one of the U-shaped members, except for each end U-shaped member, which permits the ends to cantilever towards a joint with another form member. When two or more forms are ganged end to end, an elastomeric gasket, of the same shape as shown in FIG. 17, is placed between the two with the gasket sealing against the two plywood members, one on each end of the adjoining gang forms. This permits a very uniform smooth joint and the elastomeric material, which may be from ¼ to ½ inch, completely seals the joint between the two beam forms and prevents any seepage of liquid from concrete. Also, since the ends of the beams are identical they may be readily placed together so as to form a very smooth joint with no break in the continuity of the surfaces of the beam and no flashing since the joint is sealed by the elastomer. In some cases, it may be desirable to place an additional seal in the adjoining forms, and a joining strip shown in FIG. 5 will be used to cover the joint and provide a smooth transition between the two beam sections. Normally, the strip is of the same material as the release sheets in the form, and it is the same shape as the profile of the beam, formed of sheet material of from 6 to 12 inches in width. A joining strip 32, includes a flat section 33*a* which is arranged to lie on a top plate of the adjoining form sections with the nails driven through that section into both of the plates. A side beam contacting section 33*b* joins the top section 33*a* and a bottom section 33*c*. An opposite side 33*d* is secured to the bottom section 33*c*, and a top section 33*e* is arranged to be nailed to the opposite top plates of the beam forms. This joining strip may be used for adjoining sections of a beam or for connecting a beam end with other members, for example, a column, explained below.

Figure 6:
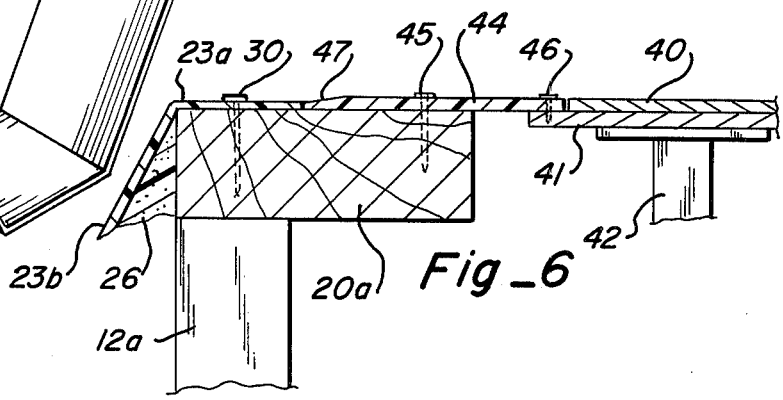
FIG. 6 is an enlarged detailed view of a connector strip for the beam form of the invention and other deck forms.
Figure 7:
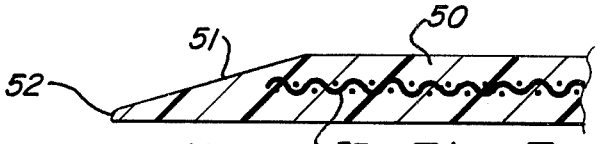
FIG. 7 is an enlarged detail, in section, of a modified type of joint connector.

For a substantial amount of construction, the beam form is arranged to be used with flying deck forms, which are large members having a planar surface arranged to be used in conjunction with the beam form to produce an integral beam and floor or deck section. Due to the fact that both the beam forms and the flying deck forms are very large, and due to the fact that the stripping must be accomplished by dropping the forms away from set concrete, each beam form must be spaced from adjacent flying deck forms. This produces a space between the two forms, and a space filler and joining strip is provided to produce a smooth joint between the two sections of the set concrete. As shown in FIG. 6, a flying deck form (partially shown) includes an upper plywood member 40 and a lower plywood member 41 mounted on a support 42. The deck form must be spaced from the top plate 20*a* of the beam form and a connector or joining strip 44 is nailed, by means of nails 45, to the plate 20 and by nails 46 to the plywood sheet 41. The connector 44 includes a sloped or feathered edge 47 which abutts the polyethylene sheet section 23*a* feathering to its thickness making a smooth joint, and it provides a transition from the deck to the beam, producing a smooth joint in the cured concrete without additional finishing. Note that the flying deck form is shown in simplified construction. Normally such forms include lower truss members, etc., for supporting the weight of the concrete poured on the deck, and a plurality of supports are used to hold the flying form in position. Such flying forms are known in the art and are not intended to be covered in this application. The joining or transition sheet 45 may be from 6 inches to 1 foot in width and of a length necessary to provide a joint between the upper plywood sheet 40 and the plastic sheet 23*a* of the beam form. In some cases, the distance between two adjacent form members may be sufficient that a reinforced transition strip may be required. A form of reinforced strip is shown in FIG. 7. The reinforced strip includes a body 50 terminating in a sloped end portion 51 to an end 52 which is approximately the same thickness as the plastic sheet of the beam form. A metalic screen, fabric screen, or other type material 53 is embedded in the strip and provides reinforcing for the joining strip when spanning large spaces between the various forms. The joining strip may be made of an elastomer, for example, polyurethane, polypropylene, any of the vinyls, or the like, which is sufficiently strong to provide strength for itself and for the weight of fluid concrete thereabove.

Figure 8:
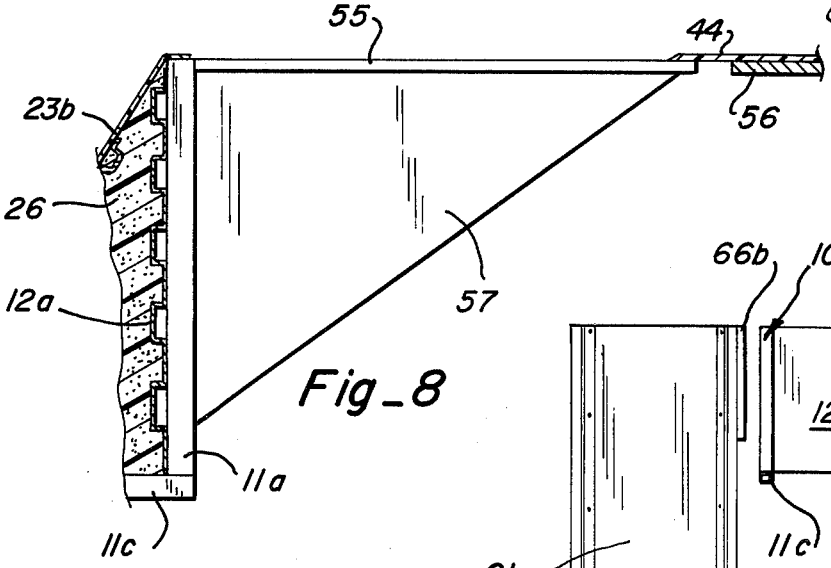
FIG. 8 is a partial side elevational view of an extended wing for the beam form of the invention for spanning a distance to a flying deck form.

In some instances, it may be desirable to provide a wider wing for the beam form to join with a flying form. One type is shown in FIG. 8. A plywood sheet 55 (of requisite thickness) may be secured to the beam form to span the distance from the uprights 11*a* to a flying form for a deck 56. The planar sheet 55 may be supported in position by triangular shaped support members or gussets 57, which are mounted on the uprights 11*a*, the metal sheet 12*a* or cross members which may be provided on the upright members. The number of triangular sheets for support may be sufficient to support the weight of the wing and the concrete poured thereon. A transition strip 44 may be nailed to the wing 55 and the flying deck form 56 to provide a smooth transition of the concrete between the deck form and the wing.

Figure 5:
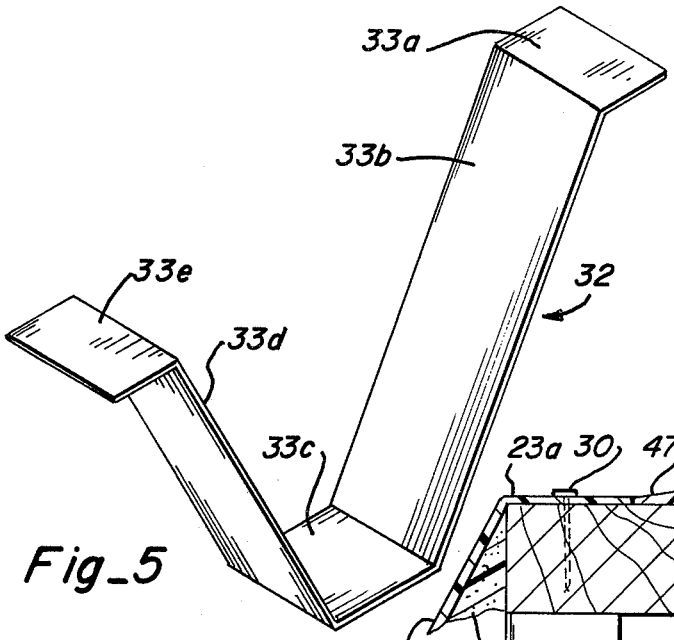
Figure 9:
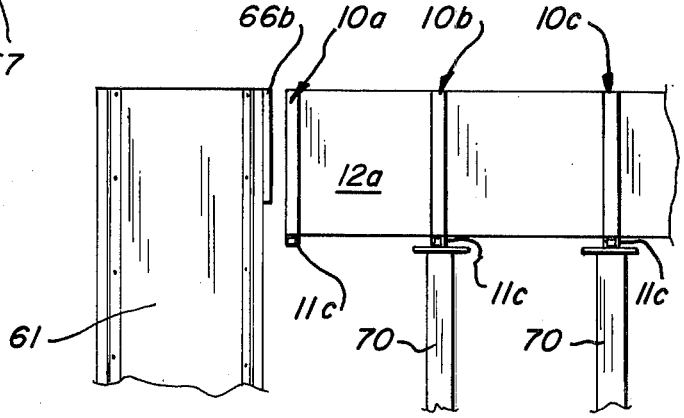
FIG. 9 is a reduced scale, side elevational view of a beam form supported in position with a column form, according to the invention.
Figure 11:
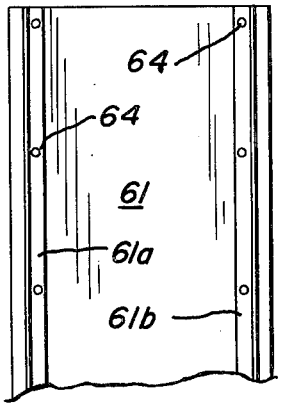
FIG. 11 is a side elevational view of a column form according to the invention.
Figure 10:
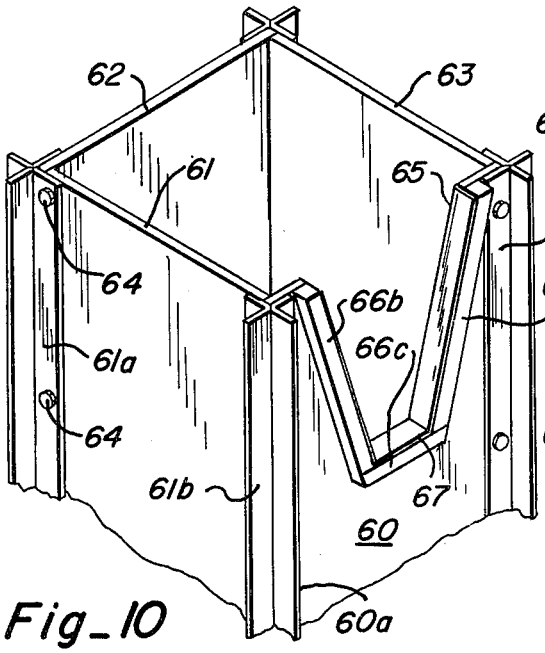
FIG. 10 is a perspective view of the top portion of a beam form according to the invention showing an attachment collar for a beam to thereby form a beam-column structure.
Figure 12:
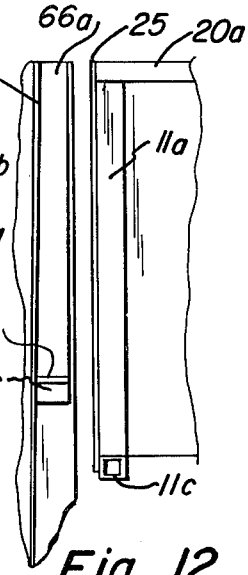
FIG. 12 is a detailed, enlarged view of the connection between a column form and a beam form according to the invention.

As pointed out, the beam form is arranged to be associated with a column to produce an integral column and beam, which are poured at the same time. For this purpose, a column form is shown in FIGS. 10 and 11, wherein plywood sheets 60, 61, 62 and 63 are each arranged with metal angles along their edges so as to be formed into a rectangular column. The beam form sheet 60 includes angles 60*a* and 60*b* while the sheet 61 includes angles 61*a* and 61*b*. The angles may be attached to their respective sheets by means of bolts, rivots, or the like, shown at 64 and any type of clamp may be used for securing the angles together to provide the rigid construction necessary for holding concrete in columnar form. Of course, the form is placed around reinforcing bar framework to provide the necessary strength for the concrete structure. Panel 60 is provided with a cutout 65 which is of the same shape as the concrete beam, and the opening includes 2 × 2 wooden members 66*a*, 66*b* and 66*c*. These are covered by an elastomeric strip 67. This opening mates with the opening (such as opening 26) of the end member 25 of a beam form. As shown in FIGS. 9 and 12, the beam form is placed so as to provide a space between the two forms, and a joining member 32, such as shown in FIG. 5, is placed over the joint between the two members. The essentially rigid joining strip may be nailed to the wooden members, both of the column opening and the beam. This seals the joint from leaking. The bottom 66*c* and the bottom of the opening of the beam form provide a base for section 33*c*, and the sides 33*b* and 33*d* cover the side openings. The plastic connector (of similar material to the beam form liner) provides a good seal which prevents leakage, and, also, supports the fluid concrete over the space between adjacent forms so that the finished concrete has a smooth joint and does not need any hand labor to seal any cracks or correct defects formed by the joint. As shown in FIG. 9, a support 70 under the U-shaped member 70*b* permits the beam form to cantilever from that support to the connection between it and the column. The beam form is sufficiently strong to permit the cantilevering without racking or deflection of the form under the weight of the concrete. Such an arrangement completely simplifies the form fabrication and, also, the stripping of the form from the set concrete. A space between the beam form, a column form and a flying deck form permits the various forms to be skewed around to fit and to take up various discrepancies in the actual construction and placement of the forms for the concrete poured. The connector for the joints produces smooth finished joints in the concrete.

Figure 13:
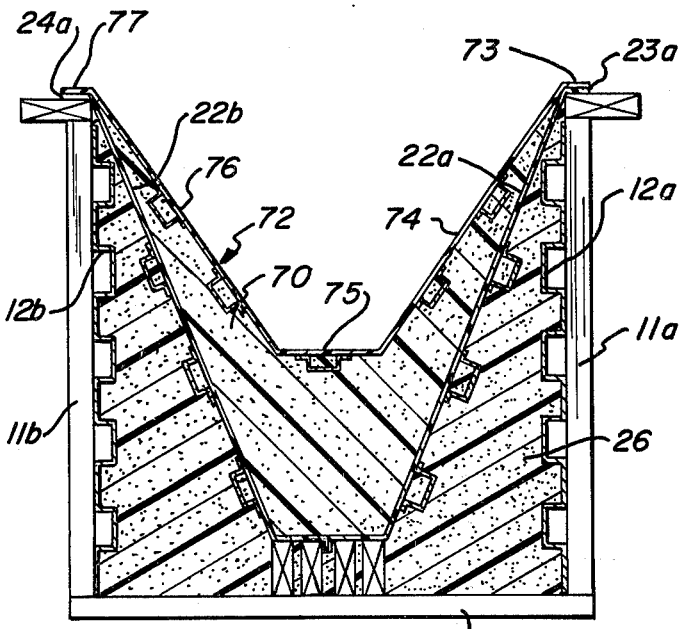
FIG. 13 is an end elevational view of an insert for a beam form according to the invention, showing the use of the form with inserts to produce different sizes of beams.

A large majority of construction companies are unable to carry an inventory of beam forms of various sizes, and, therefore, purchase the necessary beam forms for the particular jobs as they come along. For the commercially available beam forms, this has been more or less satisfactory since the forms are generally torn up and destroyed in removing the forms from a few uses of the beam form. With the form of the present invention, however, it is a long term arrangement, useful for many uses and its construction is such that it is not torn up on removal from a beam. To permit a user to make different sizes of beams in the same basic form or to provide different shapes of beams in the same basic form, an insert may be utilized, as shown in FIG. 13. An insert 70 of rigid polyurethane foam is formed with a shape, which on the outside matches the shape of the polyethylene sheets 22*a* and 22*b*, and in fact may be formed in the depression space between the two polyethylene sheets for the beam. An essentially rigid polyethylene inner liner 72 (similar to the liner 22 of the basic beam form), which includes an upper section 73 arranged to overlie the section 23*a* of the inner liner, a planar wall section 74 and bottom 75 which connects with the opposite wall section 76. The wall section 76 includes an overlay section 77 which overlies section 24*a* of the original liner for the beam. The two bodies of the rigid polyurethane foam 26 and 70 are sufficient to support the weight of concrete in the beam along with any reinforcing bar which may be necessary for the finished beam. The insert may be made of any desired shape to produce the cross-sectional profile of the beam as required. The end covering for the beam form must, of course, have an opening which conforms with the beam cross-sectional profile of the insert. The beam form with the insert may be attached to columns, decks, other beam forms and the like as desired following the same procedure as set forth for the other beam forms.

Figure 14:
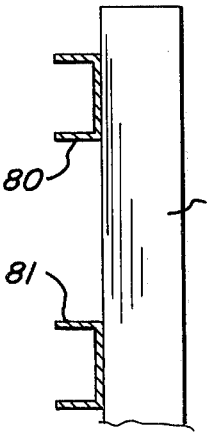
FIG. 14 is an enlarged detail view of channel shaped attachments as U-braces for a beam form according to the invention.
Figure 15:
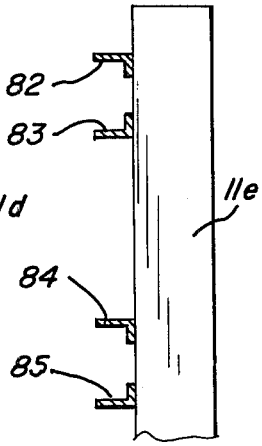
FIG. 15 is a detailed view of a modified form of channel attachments for a beam according to the invention.
Figure 16:
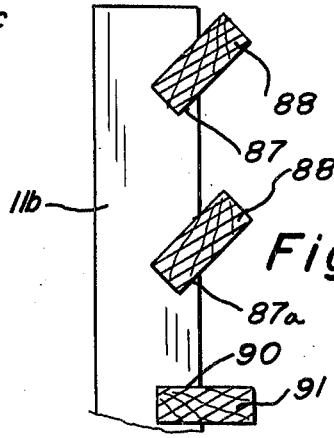
FIG. 16 is a detailed view of a portion of a U-shaped brace illustrating the use of slots for lateral support members according to the invention.

As with most types of forms for concrete construction, various supporting members may be necessary and the device of the present invention provides a versatility for the inclusion of various types of supports, wales, longitudinal supports, lateral supports and the like. One means of attaching to such supports is shown in FIG. 14, wherein an upright 11*d* has a series of channels 80 and 81 tack welded, bolted or otherwise secured to the upright at various locations along its length, as desired, by the contractor. The distance apart and the number of channels may be varied according to the particular need. A different type of support arrangement is shown in FIG. 15 where an upright 11*e* has a pair of facing angles 82 and 83 which are secured by welding, bolting, or otherwise, to the upright at spaced intervals along the upright. The facing angles may be spaced apart to accommodate any width of lumber, for example, 2 × 4 lumber, 2 × 6 lumber, etc., and the pairs may be spaced along the upright as desired. In some cases, only a single angle may be necessary and this may support lumber, beams or the like by bolting or otherwise securing the same to the angles. As shown in FIG. 16, a 45° groove 87 in an upright 11*f* provides means for holding a 2 × 6 inches beam 88, or other dimension lumber as required. In a similar manner, a groove 87*a* is cut in the upright 11*f* at a distance from the groove 87 determined by the requirements of the construction and another lumber beam 88*a* may be placed in the groove. A perpendicular groove 90 cut into the side of the upright 11*f* is arranged to hold a beam 91 in horizontal position in a similar manner. These beams may be used to support such items as, for example, the triangular brace 57 of FIG. 8, or any other support for flying deck form or the like.

The versatility of the unit is obvious, reducing framing costs, as well as casting costs by reason of the multiple use. The strength of the beam form reduces the number of supports necessary and thereby reduces framing costs. The rigidity of the beam form and its resistance to racking, also, reduces the number of supports and costs of framing. The smooth joints made with the use of the invention reduces expensive hand labor patching up unsightly defects found in structures made with prior art forms. The liners for the beam in the forms may be surfaced to produce decorative finished beams, and the columns may be, likewise, formed with decorative surfaces by placing liners on the plywood sheets as is known in the art. The joining strips and collars make such decorative surfaces continuous and without defects.

We claim:

1. A rigid, lightweight beam form for molding long concrete beams comprising:

a. a plurality of U-shaped members spaced apart;

b. a pair of opposed corrugated metal sheets secured to the insides of the legs of said U-shaped members in generally upright, parallel position;

c. a bottom support assembly secured to the cross members of said U-shaped members and extending the length of the form;

d. non-stick, flexible, but essentially rigid, plastic sheet means extending longitudinally of the form and extending laterally from the top of one of said corrugated metal sheets to the top of the opposite corrugated metal sheet and formed in a general U-shape having the profile of the desired beam; and e. essentially rigid, foamed plastic filling the space between said non-stick plastic sheet means and said opposed corrugated metal sheets and adhered thereto.

2. A beam form according to claim 1 wherein said U-shaped members are metal.

3. A beam form according to claim 1 wherein said non-stick plastic sheet means includes means for adhering the same to said foamed plastic.

4. A beam form according to claim 3 wherein said means for adhering said plastic sheet means to said foamed plastic includes straps secured by their ends to said non-stick plastic sheet means and embedded in said foamed plastic.

5. A beam form according to claim 1 wherein said non-stick plastic sheet means is formed of two mirror image sections mounted so as to form said beam profile.

6. A beam form according to claim 1 wherein said form is further characterized by wooden members secured to and extended outwardly along the length of the form from the top of each corrugated metal sheet for securing the form to adjacent deck sheets.

7. A beam form according to claim 1 wherein said form includes at least one end member having a cutout of the profile of said beam secured to the beam form with said cutout mating with said plastic sheet means and elastomeric gasketing means secured to said end member for joining said form to an adjacent form, thereby providing a smooth joint between two cast beams.

* * * * *